US012245735B2

(12) United States Patent
Boyer

(10) Patent No.: US 12,245,735 B2
(45) Date of Patent: Mar. 11, 2025

(54) DISHWASHER INCLUDING TUBULAR SPRAY ELEMENT WITH INTERMEDIATE SUPPORT AND/OR FLUID INLET

(71) Applicant: Midea Group Co., Ltd., Foshan (CN)

(72) Inventor: Joel Boyer, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 434 days.

(21) Appl. No.: 17/680,366

(22) Filed: Feb. 25, 2022

(65) Prior Publication Data

US 2023/0270315 A1 Aug. 31, 2023

(51) Int. Cl.

| | |
|---|---|
| ***A47L 15/46*** | (2006.01) |
| ***A47L 15/23*** | (2006.01) |
| ***A47L 15/42*** | (2006.01) |
| ***A47L 15/44*** | (2006.01) |
| ***A47L 15/48*** | (2006.01) |

(Continued)

(52) U.S. Cl.

CPC ..... *A47L 15/46* (2013.01); *A47L 15/23* (2013.01); *A47L 15/4221* (2013.01); *A47L 15/4225* (2013.01); *A47L 15/4285* (2013.01); *A47L 15/4293* (2013.01); *A47L 15/449* (2013.01); *A47L 15/486* (2013.01); *A47L 15/507* (2013.01); *A47L 15/22* (2013.01); *A47L 2501/01* (2013.01); *A47L 2501/04* (2013.01); *A47L 2501/12* (2013.01); *A47L 2501/20* (2013.01)

(58) Field of Classification Search

CPC .... A47L 15/4225; A47L 15/46; A47L 15/507; A47L 15/4293; A47L 15/23; A47L 15/486; A47L 15/22; A47L 15/4221; A47L 15/4285; A47L 15/449; A47L 2501/20; A47L 2501/12; A47L 2501/04; A47L 2501/01

See application file for complete search history.

(56) References Cited

U.S. PATENT DOCUMENTS

| | | | |
|---|---|---|---|
| 2,808,063 | A | 10/1957 | Abresch et al. |
| 2,907,335 | A | 10/1959 | Abresch |
| 2,992,779 | A | 1/1960 | James et al. |

(Continued)

FOREIGN PATENT DOCUMENTS

| | | | |
|---|---|---|---|
| CN | 2094961 | U | 2/1992 |
| CN | 2395683 | Y | 9/2000 |

(Continued)

OTHER PUBLICATIONS

International Search Report and Written Opinion issued in Application No. PCT/CN2018/074294 dated Jul. 5, 2018.

(Continued)

*Primary Examiner* — Benjamin L Osterhout

(74) *Attorney, Agent, or Firm* — Gay Ice Higdon

(57) ABSTRACT

A tubular spray element for a dishwasher is rotatably supported and/or supplied with fluid at an intermediate location along the length of the tubular spray element, such that least one aperture that directs fluid into a wash tub is disposed on each side of the intermediate location. In addition, a tubular spray element drive may be positioned externally from the wash tub and mechanically coupled to the tubular spray element through a shaft seal such that the fluid supply to the tubular spray element can be entirely within the wash tub.

22 Claims, 7 Drawing Sheets

(51) Int. Cl.
*A47L 15/50* (2006.01)
*A47L 15/22* (2006.01)

(56) References Cited

U.S. PATENT DOCUMENTS 2,939,465 A 6/1960 Kesling
2,956,572 A 10/1960 Levit et al.
2,973,907 A 3/1961 Abresch et al.
2,980,120 A 4/1961 Jacobs
3,006,557 A 10/1961 Jacobs
3,026,046 A 3/1962 Wickham et al.
3,044,842 A 7/1962 Abresch et al.
3,051,183 A 8/1962 Jacobs
3,077,200 A 2/1963 Guth
3,082,779 A 3/1963 Jacobs
3,088,474 A 5/1963 Leslie
3,101,730 A 8/1963 Harris et al.
3,115,306 A 12/1963 Graham
3,178,117 A 4/1965 Hanifan
3,192,935 A 7/1965 Hanifan
3,210,010 A 10/1965 Delapena
3,324,867 A 6/1967 Freese
3,348,775 A 10/1967 Flame
3,361,361 A 1/1968 Schutte
3,454,784 A 7/1969 Wantz et al.
3,538,927 A 11/1970 Harald
3,586,011 A 6/1971 Mazza
3,590,688 A 7/1971 Brannon
3,596,834 A 8/1971 Cushing
3,719,323 A 3/1973 Raiser
3,827,637 A 8/1974 Stephany et al.
3,854,665 A 12/1974 Rodgers
4,123,006 A 10/1978 Yukishita
4,175,575 A 11/1979 Cushing
4,226,490 A 10/1980 Jenkins et al.
4,301,822 A 11/1981 Dingler
4,398,562 A 8/1983 Saarem et al.
4,657,188 A 4/1987 Crane et al.
4,718,440 A 1/1988 Hawker et al.
4,732,323 A 3/1988 Jarvis et al.
4,822,241 A 4/1989 Jarvis et al.
5,098,020 A 3/1992 Cooper et al.
5,211,190 A 5/1993 Johnson et al.
5,226,454 A 7/1993 Cabalfin
5,341,827 A 8/1994 Kim
5,511,727 A 4/1996 Heren et al.
5,697,392 A 12/1997 Johnson et al.
5,725,002 A 3/1998 Payzant
5,752,533 A 5/1998 Edwards
5,759,647 A 6/1998 Kuroda et al.
5,927,616 A 7/1999 Grise et al.
6,053,185 A 3/2000 Cirjak et al.
6,431,188 B1 8/2002 Laszczewski, Jr. et al.
6,612,009 B1 9/2003 Laszczewski, Jr. et al.
6,694,990 B2 2/2004 Spanyer et al.
6,869,029 B2 3/2005 Ochoa et al.
6,955,742 B2 10/2005 McKay et al.
7,055,537 B2 6/2006 Elick et al.
7,182,562 B2 2/2007 Botosan et al.
7,210,315 B2 5/2007 Castelli et al.
7,252,246 B2 8/2007 Heren et al.
7,258,286 B1 8/2007 Wang et al.
7,293,435 B2 11/2007 Elexpuru et al.
7,445,013 B2 11/2008 VanderRoest et al.
7,464,718 B2 12/2008 McIntyre et al.
7,556,049 B2 7/2009 Oakes et al.
7,587,916 B2 9/2009 Rizzetto
7,594,513 B2 9/2009 VanderRoest et al.
7,607,325 B2 10/2009 Elexpuru et al.
7,650,765 B2 1/2010 Rizzetto
7,914,625 B2 3/2011 Bertsch et al.
7,935,194 B2 5/2011 Rolek
7,959,744 B2 6/2011 Sundaram et al.
8,136,537 B2 3/2012 Cerrano et al.
8,161,995 B2 4/2012 Armstrong et al.
8,191,560 B2 6/2012 Mallory et al.
8,443,765 B2 5/2013 Hollis
8,696,827 B2 4/2014 Ashrafzadeh et al.
8,778,094 B2 7/2014 Blanchard et al.
8,858,729 B2 10/2014 Buddharaju et al.
8,900,375 B2 12/2014 Gnadinger et al.
8,915,257 B2 12/2014 Büsing et al.
8,932,411 B2 1/2015 Beaudet et al.
8,978,674 B2 3/2015 Buesing
8,985,128 B2 3/2015 Pyo et al.
9,121,217 B1 9/2015 Hoffberg
9,170,584 B2 10/2015 Lum et al.
9,199,286 B2 12/2015 Jendrichowski et al.
9,204,780 B2 12/2015 Francisco et al.
9,220,393 B2 12/2015 Becker et al.
9,241,604 B2 1/2016 Dries
9,259,137 B2 2/2016 Boyer et al.
9,265,400 B2 2/2016 Bigott
9,307,888 B2 4/2016 Baldwin et al.
9,326,657 B2 5/2016 Thiyagarajan
9,480,389 B2 11/2016 Haft et al.
9,492,055 B2 11/2016 Feddema
9,532,700 B2 1/2017 Welch
9,635,994 B2 5/2017 Boyer et al.
9,655,496 B2 5/2017 Baldwin et al.
9,915,356 B2 3/2018 Chang et al.
9,936,850 B2 4/2018 Becker et al.
9,958,073 B2 5/2018 Yang
10,524,634 B2 1/2020 Digman
10,531,781 B2 1/2020 Digman et al.
10,631,708 B2 4/2020 Digman et al.
10,765,291 B2 9/2020 Digman et al.
11,026,559 B2 6/2021 Boyer
11,071,440 B2 7/2021 Digman
2005/0011544 A1 1/2005 Rosenbauer et al.
2005/0139240 A1 6/2005 Bong et al.
2005/0241680 A1 11/2005 Noh
2005/0241681 A1 11/2005 Hwang
2006/0090778 A1 5/2006 Oakes et al.
2006/0278258 A1 12/2006 Kara et al.
2007/0215187 A1 9/2007 Koch
2008/0163904 A1 7/2008 Hwang
2008/0271765 A1 11/2008 Burrows
2008/0276975 A1 11/2008 Disch
2009/0071508 A1 3/2009 Sundaram et al.
2009/0090400 A1 4/2009 Burrows et al.
2009/0145468 A1 6/2009 Chericoni
2010/0043826 A1 2/2010 Bertsch et al.
2011/0186085 A1 8/2011 Chen et al.
2012/0060875 A1 3/2012 Fauth et al.
2012/0175431 A1 7/2012 Althammer et al.
2012/0291827 A1 11/2012 Buddharaju et al.
2013/0000762 A1 1/2013 Buddharaju et al.
2013/0068265 A1 3/2013 Gnadinger et al.
2013/0137621 A1 5/2013 Kessler et al.
2013/0319483 A1 12/2013 Welch
2014/0059880 A1 3/2014 Bertsch et al.
2014/0069470 A1 3/2014 Baldwin et al.
2014/0373876 A1 12/2014 Feddema
2015/0007861 A1 1/2015 Azmi et al.
2015/0266065 A1 9/2015 Savoia
2016/0058264 A1 3/2016 Thiyagarajan
2016/0198928 A1 7/2016 Xu et al.
2017/0135548 A1 5/2017 Swarnkar
2017/0181599 A1 6/2017 Choi et al.
2017/0224190 A1 8/2017 Sakthivel et al.
2017/0265707 A1 9/2017 Roderick et al.
2017/0273535 A1 9/2017 Roderick et al.
2017/0354308 A1 12/2017 Choi et al.
2018/0035863 A1 2/2018 Liu et al.
2018/0084967 A1 3/2018 Ross et al.
2018/0110397 A1 4/2018 Kim et al.
2018/0132692 A1 5/2018 Dries
2018/0168425 A1 6/2018 Wilson et al.
2018/0192851 A1 7/2018 Gursoy et al.
2018/0220870 A1 8/2018 Beshears, Jr. et al.
2018/0271351 A1 9/2018 Park et al.
2018/0333037 A1 11/2018 Roderick et al.
2018/0360293 A1 12/2018 Boyer

(56) References Cited

U.S. PATENT DOCUMENTS

| | | | | |
|---|---|---|---|---|
| 2019/0059688 | A1 | 2/2019 | Woo et al. | |
| 2019/0099054 | A1 | 4/2019 | Digman et al. | |
| 2019/0099056 | A1 | 4/2019 | Digman | |
| 2019/0191959 | A1 | 6/2019 | Brightbill et al. | |
| 2019/0290095 | A1 | 9/2019 | Wahlberg et al. | |
| 2019/0307308 | A1 | 10/2019 | Haegermarck | |
| 2020/0077868 | A1 | 3/2020 | Digman et al. | |
| 2020/0085276 | A1* | 3/2020 | Digman | A47L 15/508 |
| 2020/0085277 | A1* | 3/2020 | Digman | A47L 15/504 |
| 2020/0085278 | A1* | 3/2020 | Digman | A47L 15/504 |
| 2020/0085279 | A1 | 3/2020 | Digman et al. | |
| 2020/0107696 | A1 | 4/2020 | Digman et al. | |
| 2020/0288940 | A1* | 9/2020 | Fawaz | A47L 15/30 |
| 2021/0076900 | A1 | 3/2021 | Feddema et al. | |
| 2021/0093149 | A1* | 4/2021 | Fawaz | A47L 15/0021 |
| 2021/0093151 | A1 | 4/2021 | Boyer et al. | |
| 2021/0093152 | A1* | 4/2021 | Boyer | A47L 15/4282 |
| 2021/0093153 | A1* | 4/2021 | Boyer | A47L 15/0039 |
| 2021/0093154 | A1* | 4/2021 | Boyer | A47L 15/46 |
| 2021/0093155 | A1* | 4/2021 | Boyer | G06T 7/62 |
| 2021/0145240 | A1* | 5/2021 | Fawaz | A47L 15/4214 |
| 2021/0145241 | A1* | 5/2021 | Dietrich | A47L 15/0021 |
| 2021/0219809 | A1* | 7/2021 | Digman | A47L 15/508 |
| 2021/0251462 | A1* | 8/2021 | Boyer | A47L 15/22 |
| 2021/0267430 | A1 | 9/2021 | Digman et al. | |

FOREIGN PATENT DOCUMENTS

| | | | |
|---|---|---|---|
| CN | 1879547 | A | 12/2006 |
| CN | 101049224 | A | 10/2007 |
| CN | 101134198 | A | 3/2008 |
| CN | 201067392 | Y | 6/2008 |
| CN | 101795613 | A | 8/2010 |
| CN | 102307508 | A | 1/2012 |
| CN | 102370450 | A | 3/2012 |
| CN | 102512128 | A | 6/2012 |
| CN | 102940476 | A | 2/2013 |
| CN | 203447254 | U | 2/2014 |
| CN | 203749364 | U | 8/2014 |
| CN | 203763025 | U | 8/2014 |
| CN | 104433985 | A | 3/2015 |
| CN | 204181567 | U | 3/2015 |
| CN | 104523208 | A | 4/2015 |
| CN | 104757921 | A | 7/2015 |
| CN | 104840165 | A | 8/2015 |
| CN | 204671085 | U | 9/2015 |
| CN | 105147218 | A | 12/2015 |
| CN | 105147220 | A | 12/2015 |
| CN | 105231971 | A | 1/2016 |
| CN | 205094364 | U | 3/2016 |
| CN | 106224508 | A | 12/2016 |
| CN | 106574786 | A | 4/2017 |
| CN | 105286746 | B | 2/2018 |
| CN | 108697298 | A | 10/2018 |
| CN | 109124522 | A | 1/2019 |
| CN | 109236874 | A | 1/2019 |
| CN | 109538865 | A | 3/2019 |
| CN | 110578787 | B | 1/2021 |
| DE | 3537184 | A1 | 4/1987 |
| DE | 20113227 | U1 | 10/2001 |
| DE | 10121083 | A1 | 10/2002 |
| DE | 10300501 | A1 | 7/2004 |
| DE | 202004013786 | U1 | 12/2004 |
| DE | 102007038673 | B3 | 1/2009 |
| DE | 102008011743 | A1 | 9/2009 |
| DE | 202014010365 | U1 | 5/2015 |
| EP | 0368096 | A2 | 5/1990 |
| EP | 0559466 | A1 | 9/1993 |
| EP | 0679365 | A1 | 11/1995 |
| EP | 0764421 | A1 | 3/1997 |
| EP | 0786231 | A2 | 7/1997 |
| EP | 0826427 | A2 | 3/1998 |
| EP | 0864291 | A1 | 9/1998 |
| EP | 1132038 | A2 | 9/2001 |
| EP | 1136030 | A1 | 9/2001 |
| EP | 1238622 | A2 | 9/2002 |
| EP | 1252856 | A2 | 10/2002 |
| EP | 1632166 | A2 | 3/2006 |
| EP | 1758494 | A1 | 3/2007 |
| EP | 2452759 | A1 | 5/2012 |
| EP | 2636786 | A1 | 9/2013 |
| EP | 2059160 | B1 | 3/2015 |
| EP | 3222191 | A1 | 9/2017 |
| FR | 1473796 | A | 3/1967 |
| GB | 572623 | A | 10/1945 |
| GB | 2244209 | A | 11/1991 |
| JP | 2003339607 | A | 12/2003 |
| JP | 2014121353 | A | 7/2014 |
| KR | 100786069 | B1 | 12/2007 |
| KR | 200442414 | Y1 | 11/2008 |
| KR | 101173691 | B1 | 8/2012 |
| KR | 200464747 | Y1 | 1/2013 |
| WO | 2009008827 | | 1/2009 |
| WO | 2016008699 | A1 | 1/2016 |
| WO | 2017022974 | A1 | 2/2017 |
| WO | 2018053635 | A1 | 3/2018 |
| WO | 2018107833 | A1 | 6/2018 |
| WO | 2018107834 | A1 | 6/2018 |
| WO | 2018107835 | A1 | 6/2018 |
| WO | 2020052211 | A1 | 3/2020 |
| WO | 2020052215 | A1 | 3/2020 |

OTHER PUBLICATIONS

Electrolux Home Products, Inc. "Dishwasher Use & Care Guide 1500 Series with Fully Electronic Control" 2003.

Scribd, Sears Kenmore Elite 2013 Stainless Steel Tall Tub Dishwasher Service Manual, www.scribd.com, Retrieved on Dec. 5, 2018.

Everyspec, Federal Specification: Dishwashing Machines, Single Tank and Double Tank, Commercial, www.everyspec.com, Oct. 17, 1983.

Encyclo, "Keyed Connector—Definition—Encyclo", https://www.encyclo.co.uk/meaning-of-Keyed_connectors, 2020.

International Search Report and Written Opinion issued in Application No. PCT/CN2020/108004 dated Oct. 26, 2020.

Boyan Manufacturing Solutions, Custom Plastic Helical Gears, Retrieved on Jul. 1, 2020.

Gardiner, Ginger, Injection-Forming for High-Performance, Unitized Thermoplastic Structures, CompositesWorld, Jul. 30, 2019.

International Search Report and Written Opinion issued in Application No. PCT/CN2021/110530, dated Oct. 27, 2021, 10 pages.

International Search Report and Written Opinion issued in Application No. PCT/CN2018/074268 dated Jul. 13, 2018.

International Search Report and Written Opinion issued in Application No. PCT/CN2019/079236 dated Jun. 25, 2019.

International Search Report and Written Opinion issued in Application No. PCT/CN2019/078799 dated Jun. 26, 2019.

International Search Report and Written Opinion issued in Application No. PCT/CN2019/078612 dated Jun. 28, 2019.

International Search Report and Written Opinion issued in Application No. PCT/CN2019/078611 dated Jun. 5, 2019.

International Search Report and Written Opinion issued in Application No. PCT/CN2019/097332 dated Dec. 9, 2019.

International Search Report and Written Opinion issued in Application No. PCT/CN2021/110536 dated Oct. 26, 2021.

* cited by examiner

DISHWASHER INCLUDING TUBULAR SPRAY ELEMENT WITH INTERMEDIATE SUPPORT AND/OR FLUID INLET

BACKGROUND

Dishwashers are used in many single-family and multi-family residential applications to clean dishes, silverware, cutlery, cups, glasses, pots, pans, etc. (collectively referred to herein as "utensils"). Many dishwashers rely primarily on rotatable spray arms that are disposed at the bottom and/or top of a tub and/or are mounted to a rack that holds utensils. A spray arm is coupled to a source of wash fluid and includes multiple apertures for spraying wash fluid onto utensils, and generally rotates about a central hub such that each aperture follows a circular path throughout the rotation of the spray arm. The apertures may also be angled such that force of the wash fluid exiting the spray arm causes the spray arm to rotate about the central hub.

While traditional spray arm systems are simple and mostly effective, they have the shortcoming that they must spread the wash fluid over all areas equally to achieve a satisfactory result. In doing so, resources such as time, energy and water are generally wasted because wash fluid cannot be focused precisely where it is needed. Moreover, because spray arms follow a generally circular path, the corners of a tub may not be covered as thoroughly, leading to lower cleaning performance for utensils located in the corners of a rack. In addition, in some instances the spray jets of a spray arm may be directed to the sides of a wash tub during at least portions of the rotation, leading to unneeded noise during a wash cycle.

A different approach to traditional spray arm systems utilizes one or more tubular spray elements to spray utensils within a dishwasher. A tubular spray element is a type of rotatable conduit that both conveys wash fluid along its length and ejects the wash fluid through various apertures disposed on an exterior surface thereof. A tubular spray element is generally formed of an elongated body and rotates about a longitudinal axis thereof, either in a controllable or uncontrollable fashion, e.g., based upon an electric drive, a hydraulic drive, or as a result of rotational forces imparted by the ejection of wash fluid from the tubular spray element.

It has been found, however, that the placement of one or more tubular spray elements within the lower area of a wash tub under the lower rack can present challenges in some dishwasher designs, particularly when there is a seam that joins a wash tub bottom to a wash tub wrapper, in part due to the geometries that may be required in order to transition from one piece to the other.

SUMMARY

The herein-described embodiments address these and other problems associated with the art by providing a dishwasher and method for making and/or using the same utilizing a tubular spray element that is rotatably supported and/or supplied with fluid at an intermediate location along the length of the tubular spray element, such that least one aperture that directs fluid into a wash tub is disposed on each side of the intermediate location. In addition, in some instances, a tubular spray element drive may be positioned externally from the wash tub and mechanically coupled to the tubular spray element through a shaft seal such that the fluid supply to the tubular spray element can be entirely within the wash tub.

Therefore, consistent with one aspect of the invention, a dishwasher may include a wash tub, a tubular spray element disposed in the wash tub and being rotatable about a longitudinal axis thereof, the tubular spray element including a plurality of apertures extending through an exterior surface thereof, and the tubular spray element including a fluid inlet disposed between first and second apertures among the plurality of apertures, the fluid inlet in fluid communication with a fluid supply to direct fluid received from the fluid supply into the wash tub through the plurality of apertures, and a tubular spray element drive coupled to the tubular spray element and configured to rotate the tubular spray element between a plurality of rotational positions about the longitudinal axis thereof.

In some embodiments, the tubular spray element includes first and second opposing ends that are sealed and disposed in the wash tub. Also, in some embodiments, the tubular spray element drive includes a motor disposed external to the wash tub, a drive shaft driven by the motor and projecting through the wash tub through a shaft seal, and a drive component driven by the drive shaft and disposed within the wash tub, the drive component mechanically coupled to the tubular spray element such that rotation of the motor drives the drive shaft and the drive component to rotate the tubular spray element.

Further, in some embodiments, the drive shaft extends along the longitudinal axis, and the drive component includes a first keyed coupler engaging a second keyed coupler disposed at an end of the tubular spray element. In some embodiments, the drive shaft extends substantially parallel to the longitudinal axis, and the drive component includes a first gear and the tubular spray element includes a second gear that mates with and is driven by the first gear. In addition, in some embodiments, the tubular spray element drive includes a position sensor configured to sense a rotational position of the tubular spray element, and the dishwasher further includes a controller coupled to the tubular spray element drive and configured to control the tubular spray element drive to discretely direct the tubular spray element to a predetermined rotational position to direct fluid from the fluid supply in a predetermined direction from the plurality of apertures.

Some embodiments may also include a manifold disposed in the wash tub and in fluid communication with the fluid supply, and the tubular spray element projects through opposing sides of the manifold and the fluid inlet is disposed within the manifold. In addition, some embodiments may also include a diverter configured to selectively route wash fluid from the fluid supply to one or more of a plurality of outlets, and the manifold is in fluid communication with a first outlet of the plurality of outlets.

Moreover, in some embodiments, the tubular spray element further includes a radially-facing inlet in fluid communication with the fluid inlet and disposed on a valve member that rotates with the tubular spray element, and the manifold includes a radially-facing valve body disposed at a predetermined radius from the longitudinal axis to substantially block fluid flow from the manifold to the fluid inlet when the tubular spray element is rotated to a predetermined rotational position about the longitudinal axis.

In some embodiments, the manifold is mounted to the wash tub and supports the tubular spray element within the wash tub. Moreover, in some embodiments, the manifold is mounted to a bottom of the wash tub.

In some embodiments, the tubular spray element is a first tubular spray element, and the dishwasher further includes a second tubular spray element disposed in the wash tub and being rotatable about a longitudinal axis thereof, the second tubular spray element supported by the manifold and extending substantially parallel to the first tubular spray element. In addition, in some embodiments, the first and second tubular spray elements are mechanically coupled to one another such that rotation of the first tubular spray element by the tubular spray element drive rotates the second tubular spray element. In some embodiments, the first and second tubular spray elements include respective first and second gears, and the manifold includes a third gear interposed between the first and second gears such that the first and second tubular spray elements rotate in a same direction when the first tubular spray element is rotated by the tubular spray element drive.

Moreover, in some embodiments, the tubular spray element drive is a first tubular spray element drive, and the dishwasher further includes third and fourth tubular spray elements disposed in the wash tub and being rotatable about respective longitudinal axes thereof, each of the third and fourth tubular spray elements supported by the manifold and extending substantially parallel to the first and second tubular spray elements, and the third and fourth tubular spray elements mechanically coupled to one another such that rotation of the third tubular spray element rotates the fourth tubular spray element, and a second tubular spray element drive coupled to the third tubular spray element and configured to rotate the third tubular spray element between a plurality of rotational positions about the longitudinal axis thereof.

In addition, some embodiments may further include a rack for storing utensils to be washed, and the tubular spray element extends underneath the rack to spray upwardly into the rack. In some embodiments, the rack is a lower rack, and the tubular spray element is positioned proximate to a bottom of the wash tub. In addition, some embodiments may also include a tubular spray element support configured to rotatably support the tubular spray element intermediate first and second opposing ends thereof, and at least one of the plurality of apertures is disposed intermediate the first end and the tubular spray element support and at least one of the plurality of apertures is disposed intermediate the second end and the tubular spray element support.

Consistent with another aspect of the invention, a dishwasher may include a wash tub, a tubular spray element disposed in the wash tub and being rotatable about a longitudinal axis thereof, the tubular spray element including a plurality of apertures extending through an exterior surface thereof and configured to direct fluid received by the tubular spray element from a fluid supply into the wash tub, and a tubular spray element support configured to rotatably support the tubular spray element intermediate first and second opposing ends thereof, where at least one of the plurality of apertures is disposed intermediate the first end and the tubular spray element support and at least one of the plurality of apertures is disposed intermediate the second end and the tubular spray element support.

Also, in some embodiments, the tubular spray element support includes a manifold configured to receive fluid from the fluid supply, and the tubular spray element includes a fluid inlet positioned within the manifold and configured to route fluid from the manifold to the plurality of apertures.

Consistent with another aspect of the invention, a dishwasher may include a wash tub, a tubular spray element disposed in the wash tub and being rotatable about a longitudinal axis thereof, the tubular spray element including first and second opposing ends that are sealed and disposed in the wash tub, a fluid inlet disposed in the wash tub and in fluid communication with a fluid supply, and a plurality of apertures extending through an exterior surface of the tubular spray element and configured to direct fluid received from the fluid supply into the wash tub, and a tubular spray element drive coupled to the tubular spray element and configured to rotate the tubular spray element between a plurality of rotational positions about the longitudinal axis thereof, the tubular spray element drive including a motor disposed external to the wash tub, a drive shaft driven by the motor and projecting through the wash tub through a shaft seal, and a drive component driven by the drive shaft and disposed within the wash tub, the drive component mechanically coupled to the tubular spray element such that rotation of the motor drives the drive shaft and the drive component to rotate the tubular spray element.

In addition, some embodiments may further include a manifold in fluid communication with the fluid supply and configured to rotatably support the tubular spray element intermediate the first and second opposing ends thereof, at least one of the plurality of apertures is disposed intermediate the first end and the manifold and at least one of the plurality of apertures is disposed intermediate the second end and the manifold, and the fluid inlet is disposed within the manifold to receive fluid from the fluid supply.

Other embodiments may include various methods for making and/or using any of the aforementioned constructions.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
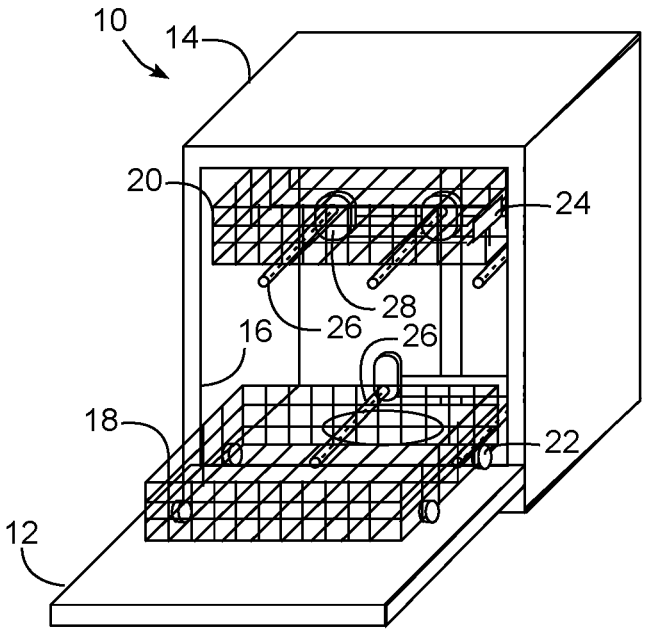
FIG. 1 is a perspective view of a dishwasher consistent with some embodiments of the invention.

In some embodiments consistent with the invention, a tubular spray element is rotatably supported and/or supplied with fluid through an intermediate location along the length of the tubular spray element, such that least one aperture that directs fluid into a wash tub is disposed on each side of the intermediate location.

A tubular spray element, in this regard, may be considered to be a type of rotatable conduit that includes a body capable of communicating a fluid such as water, a wash fluid including water, detergent and/or another treatment composition, or pressurized air, and that is capable of communicating the fluid to one or more apertures or nozzles to spray fluid onto utensils within a wash tub. A tubular spray element generally includes an elongated body, which may be generally cylindrical in some embodiments but may also have other cross-sectional profiles in other embodiments, and which has one or more apertures disposed on an exterior surface thereof and in fluid communication with a fluid supply, e.g., through one or more internal passageways defined therein. A tubular spray element also has a longitudinal axis generally defined along its longest dimension and about which the tubular spray element rotates. Further, when a tubular spray element is mounted on a rack and configured to selectively engage with a dock based upon the position of the rack, this longitudinal axis may also be considered to be an axis of insertion. A tubular spray element may also have a cross-sectional profile that varies along the longitudinal axis, so it will be appreciated that a tubular spray element need not have a circular cross-sectional profile along its length as is illustrated in a number embodiments herein. In addition, the one or more apertures on the exterior surface of a tubular spray element may be arranged into nozzles in some embodiments, and may be fixed or movable (e.g., rotating, oscillating, etc.) with respect to other apertures on the tubular spray element. Further, the exterior surface of a tubular spray element may be defined on multiple components of a tubular spray element, i.e., the exterior surface need not be formed by a single integral component.

In addition, in some embodiments a tubular spray element may be discretely directed by a tubular spray element drive to multiple rotational positions about the longitudinal axis to spray a fluid in predetermined directions into a wash tub of a dishwasher during a wash cycle. In some embodiments, the tubular spray element may be operably coupled to such a drive through a support arrangement that both rotates the tubular spray element and supplies fluid to the tubular spray element, as will become more apparent below. Further details regarding tubular spray elements may be found, for example, in U.S. Pat. No. 10,531,781 to Digman et al., which is assigned to the same assignee as that of the present application, and which is incorporated by reference herein. In other embodiments, however, a tubular spray element may rotate in a less controlled fashion, e.g., through the use of an electric drive, a hydraulic drive, or based upon a force generated in reaction to the ejection of wash fluid from the tubular spray element itself. In such instances, the rotational position of a tubular spray element may not be discretely controlled and/or known at any given time, although other aspects of the rotation or operation of the tubular spray element may still be controlled in some embodiments, e.g., the speed of rotation, whether rotation is enabled or disabled, and/or whether fluid flow is provided to the tubular spray element, etc.

Dishwasher

Turning now to the drawings, wherein like numbers denote like parts throughout the several views, FIG. 1 illustrates an example dishwasher 10 in which the various technologies and techniques described herein may be implemented. Dishwasher 10 is a residential-type built-in dishwasher, and as such includes a front-mounted door 12 that provides access to a wash tub 16 housed within the cabinet or housing 14. Door 12 is generally hinged along a bottom edge and is pivotable between the opened position illustrated in FIG. 1 and a closed position (not shown). When door 12 is in the opened position, access is provided to one or more sliding racks, e.g., lower rack 18 and upper rack 20, within which various utensils are placed for washing. Lower rack 18 may be supported on rollers 22, while upper rack 20 may be supported on side rails 24, and each rack is movable between loading (extended) and washing (retracted) positions along a substantially horizontal direction. Control over dishwasher 10 by a user is generally managed through a control panel (not shown in FIG. 1) typically disposed on a top or front of door 12, and it will be appreciated that in different dishwasher designs, the control panel may include various types of input and/or output devices, including various knobs, buttons, lights, switches, textual and/or graphical displays, touch screens, etc. through which a user may configure one or more settings and start and stop a wash cycle.

In addition, consistent with some embodiments of the invention, dishwasher 10 may include one or more tubular spray elements (TSEs) 26 to direct a wash fluid onto utensils disposed in racks 18, 20. As will become more apparent below, tubular spray elements 26 are rotatable about respective longitudinal axes and are discretely directable by one or more tubular spray element drives (not shown in FIG. 1) to control a direction at which fluid is sprayed by each of the tubular spray elements. In some embodiments, fluid may be dispensed solely through tubular spray elements, however the invention is not so limited. For example, in some embodiments various upper and/or lower rotating spray arms may also be provided to direct additional fluid onto utensils. Still other sprayers, including various combinations of wall-mounted sprayers, rack-mounted sprayers, oscillating sprayers, fixed sprayers, rotating sprayers, focused sprayers, etc., may also be combined with one or more tubular spray elements in some embodiments of the invention.

Some tubular spray elements 26 may be fixedly mounted to a wall or other structure in wash tub 16, e.g., as may be the case for tubular spray elements 26 disposed below or adjacent lower rack 18. For other tubular spray elements 26, e.g., rack-mounted tubular spray elements, the tubular spray elements may be removably coupled to a docking arrangement such as docking arrangement 28 mounted to the rear wall of wash tub 16 in FIG. 1.

The embodiments discussed hereinafter will focus on the implementation of the hereinafter-described techniques within a hinged-door dishwasher. However, it will be appreciated that the herein-described techniques may also be used in connection with other types of dishwashers in some embodiments. For example, the herein-described techniques may be used in commercial applications in some embodiments. Moreover, at least some of the herein-described techniques may be used in connection with other dishwasher configurations, including dishwashers utilizing sliding drawers or dish sink dishwashers, e.g., a dishwasher integrated into a sink.

Figure 2:
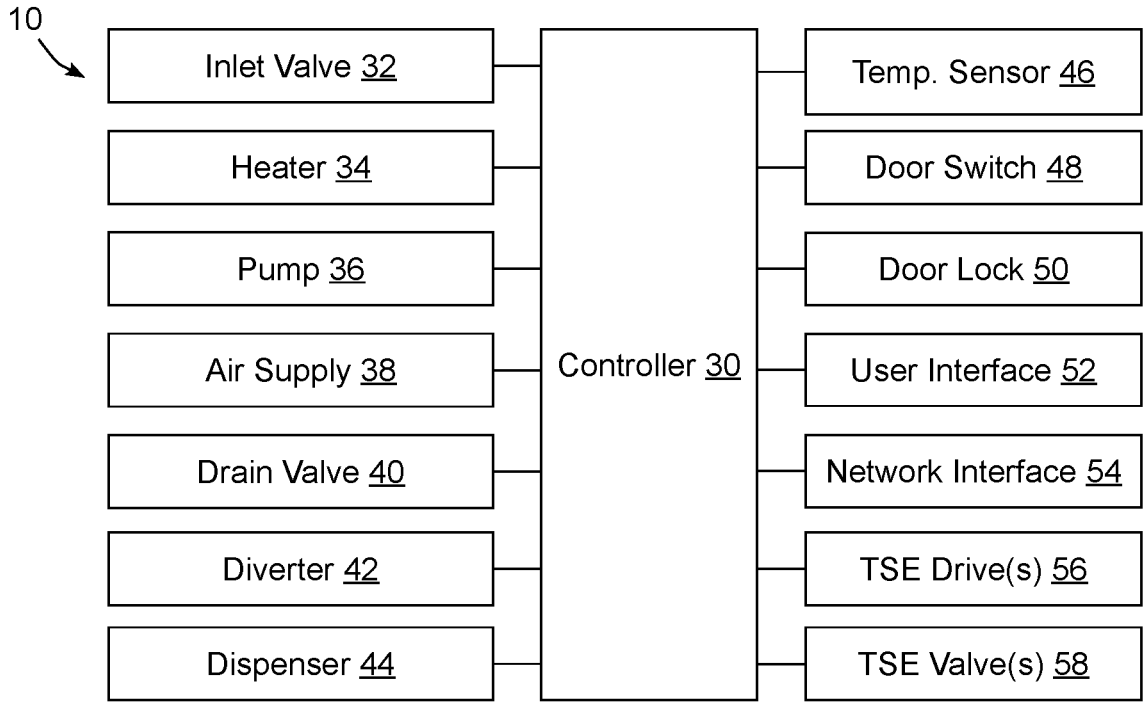
FIG. 2 is a block diagram of an example control system for the dishwasher of FIG. 1.

Now turning to FIG. 2, dishwasher 10 may be under the control of a controller 30 that receives inputs from a number of components and drives a number of components in response thereto. Controller 30 may, for example, include one or more processors and a memory (not shown) within which may be stored program code for execution by the one or more processors. The memory may be embedded in controller 30, but may also be considered to include volatile and/or non-volatile memories, cache memories, flash memories, programmable read-only memories, read-only memories, etc., as well as memory storage physically located elsewhere from controller 30, e.g., in a mass storage device or on a remote computer interfaced with controller 30.

As shown in FIG. 2, controller 30 may be interfaced with various components, including an inlet valve 32 that is coupled to a water source to introduce water into wash tub 16, which when combined with detergent, rinse agent and/or other additives, forms various wash fluids. Controller may also be coupled to a heater 34 that heats fluids, a pump 36 that recirculates wash fluid within the wash tub by pumping fluid to the wash arms and other spray devices in the dishwasher, an air supply 38 that provides a source of pressurized air for use in drying utensils in the dishwasher, a drain valve 40 that is coupled to a drain to direct fluids out of the dishwasher, and a diverter 42 that controls the routing of pumped fluid to different tubular spray elements, spray arms and/or other sprayers during a wash cycle. In some embodiments, a single pump 36 may be used, and drain valve 40 may be configured to direct pumped fluid either to a drain or to the diverter 42 such that pump 36 is used both to drain fluid from the dishwasher and to recirculate fluid throughout the dishwasher during a wash cycle. In other embodiments, separate pumps may be used for draining the dishwasher and recirculating fluid. Diverter 42 in some embodiments may be a passive diverter that automatically sequences between different outlets, while in some embodiments diverter 42 may be a powered diverter that is controllable to route fluid to specific outlets on demand. In still other embodiments, and as will be discussed in greater detail below, each tubular spray element may be separately controlled such that no separate diverter is used. Air supply 38 may be implemented as an air pump or fan in different embodiments, and may include a heater and/or other air conditioning device to control the temperature and/or humidity of the pressurized air output by the air supply.

In the illustrated embodiment, pump 36 and air supply 38 collectively implement a fluid supply for dishwasher 100, providing both a source of wash fluid and pressurized air for use respectively during wash and drying operations of a wash cycle. A wash fluid may be considered to be a fluid, generally a liquid, incorporating at least water, and in some instances, additional components such as detergent, rinse aid, and other additives. During a rinse operation, for example, the wash fluid may include only water. A wash fluid may also include steam in some instances. Pressurized air is generally used in drying operations, and may or may not be heated and/or dehumidified prior to spraying into a wash tub. It will be appreciated, however, that pressurized air may not be used for drying purposes in some embodiments, so air supply 38 may be omitted in some instances. Moreover, in some instances, tubular spray elements may be used solely for spraying wash fluid or spraying pressurized air, with other sprayers or spray arms used for other purposes, so the invention is not limited to the use of tubular spray elements for spraying both wash fluid and pressurized air.

Controller 30 may also be coupled to a dispenser 44 to trigger the dispensing of detergent and/or rinse agent into the wash tub at appropriate points during a wash cycle. Additional sensors and actuators may also be used in some embodiments, including a temperature sensor 46 to determine a wash fluid temperature, a door switch 48 to determine when door 12 is latched, and a door lock 50 to prevent the door from being opened during a wash cycle. Moreover, controller 30 may be coupled to a user interface 52 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 30 may also be coupled to one or more network interfaces 54, e.g., for interfacing with external devices via wired and/or wireless networks such as Ethernet, Bluetooth, NFC, cellular and other suitable networks. Additional components may also be interfaced with controller 30, as will be appreciated by those of ordinary skill having the benefit of the instant disclosure. For example, one or more tubular spray element (TSE) drives 56 and/or one or more tubular spray element (TSE) valves 58 may be provided in some embodiments to discretely control one or more tubular spray elements disposed in dishwasher 10, as will be discussed in greater detail below.

It will be appreciated that each tubular spray element drive 56 may also provide feedback to controller 30 in some embodiments, e.g., a current position and/or speed, although in other embodiments a separate position sensor may be used. In addition, as will become more apparent below, flow regulation to a tubular spray element may be performed without the use of a separately-controlled tubular spray element valve 58 in some embodiments, e.g., where rotation of a tubular spray element by a tubular spray element drive is used to actuate a mechanical valve.

Moreover, in some embodiments, at least a portion of controller 30 may be implemented externally from a dishwasher, e.g., within a mobile device, a cloud computing environment, etc., such that at least a portion of the functionality described herein is implemented within the portion of the controller that is externally implemented. In some embodiments, controller 30 may operate under the control of an operating system and may execute or otherwise rely upon various computer software applications, components, programs, objects, modules, data structures, etc. In addition, controller 30 may also incorporate hardware logic to implement some or all of the functionality disclosed herein. Further, in some embodiments, the sequences of operations performed by controller 30 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the dishwasher illustrated in FIGS. 1-2 will be apparent to one of ordinary skill in the art, as will become apparent from the description below. Therefore, the invention is not limited to the specific implementations discussed herein.

Tubular Spray Elements

Figure 3:
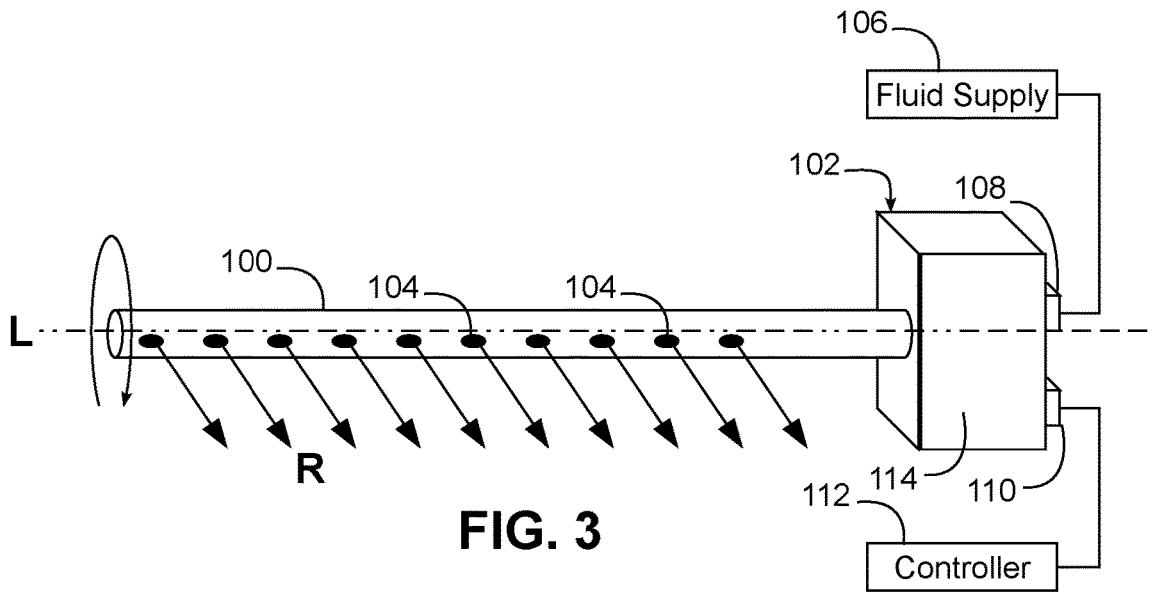
FIG. 3 is a side perspective view of a tubular spray element and tubular spray element drive from the dishwasher of FIG. 1.

Now turning to FIG. 3, in some embodiments, a dishwasher may include one or more discretely directable tubular spray elements, e.g., tubular spray element 100 coupled to a tubular spray element drive 102. Tubular spray element 100 may be configured as a tube or other elongated body disposed in a wash tub and being rotatable about a longitudinal axis L. In addition, tubular spray element 100 is generally hollow or at least includes one or more internal fluid passages that are in fluid communication with one or more apertures 104 extending through an exterior surface thereof. Each aperture 104 may function to direct a spray of fluid into the wash tub, and each aperture may be configured in various manners to provide various types of spray patterns, e.g., streams, fan sprays, concentrated sprays, etc. Apertures 104 may also in some instances be configured as fluidic nozzles providing oscillating spray patterns.

Moreover, as illustrated in FIG. 3, apertures 104 may all be positioned to direct fluid along a same radial direction from axis L, thereby focusing all fluid spray in generally the same radial direction represented by arrows R. In other embodiments, however, apertures may be arranged differently about the exterior surface of a tubular spray element, e.g., to provide spray from two, three or more radial directions, to distribute a spray over one or more arcs about the circumference of the tubular spray element, etc.

Tubular spray element 100 is in fluid communication with a fluid supply 106, e.g., through a port 108 of tubular spray element drive 102, to direct fluid from the fluid supply into the wash tub through the one or more apertures 104. Tubular spray element drive 102 is coupled to tubular spray element 100 and is configured to discretely direct the tubular spray element 100 to each of a plurality of rotational positions about longitudinal axis L. By "discretely directing," what is meant is that tubular spray element drive 102 is capable of rotating tubular spray element 100 generally to a controlled rotational angle (or at least within a range of rotational angles) about longitudinal axis L. Thus, rather than uncontrollably rotating tubular spray element 100 or uncontrollably oscillating the tubular spray element between two fixed rotational positions, tubular spray element drive 102 is capable of intelligently focusing the spray from tubular spray element 100 between multiple rotational positions. It will also be appreciated that rotating a tubular spray element to a controlled rotational angle may refer to an absolute rotational angle (e.g., about 10 degrees from a home position) or may refer to a relative rotational angle (e.g., about 10 degrees from the current position).

Tubular spray element drive 102 is also illustrated with an electrical connection 110 for coupling to a controller 112, and a housing 114 is illustrated for housing various components in tubular spray element drive 102 that will be discussed in greater detail below. In the illustrated embodiment, tubular spray element drive 102 is configured as a base that supports, through a rotary coupling, an end of the tubular spray element and effectively places the tubular spray element in fluid communication with port 108.

By having an intelligent control provided by tubular spray element drive 102 and/or controller 112, spray patterns and cycle parameters may be increased and optimized for different situations. For instance, tubular spray elements near the center of a wash tub may be configured to rotate 360 degrees, while tubular spray elements located near wash tub walls may be limited to about 180 degrees of rotation to avoid spraying directly onto any of the walls of the wash tub, which can be a significant source of noise in a dishwasher. In another instance, it may be desirable to direct or focus a tubular spray element to a fixed rotational position or over a small range of rotational positions (e.g., about 5-10 degrees) to provide concentrated spray of liquid, steam and/or air, e.g., for cleaning silverware or baked on debris in a pan. In addition, in some instances the rotational velocity of a tubular spray element could be varied throughout rotation to provide longer durations in certain ranges of rotational positions and thus provide more concentrated washing in particular areas of a wash tub, while still maintaining rotation through 360 degrees. Control over a tubular spray element may include control over rotational position, speed or rate of rotation and/or direction of rotation in different embodiments of the invention.

Figure 4:
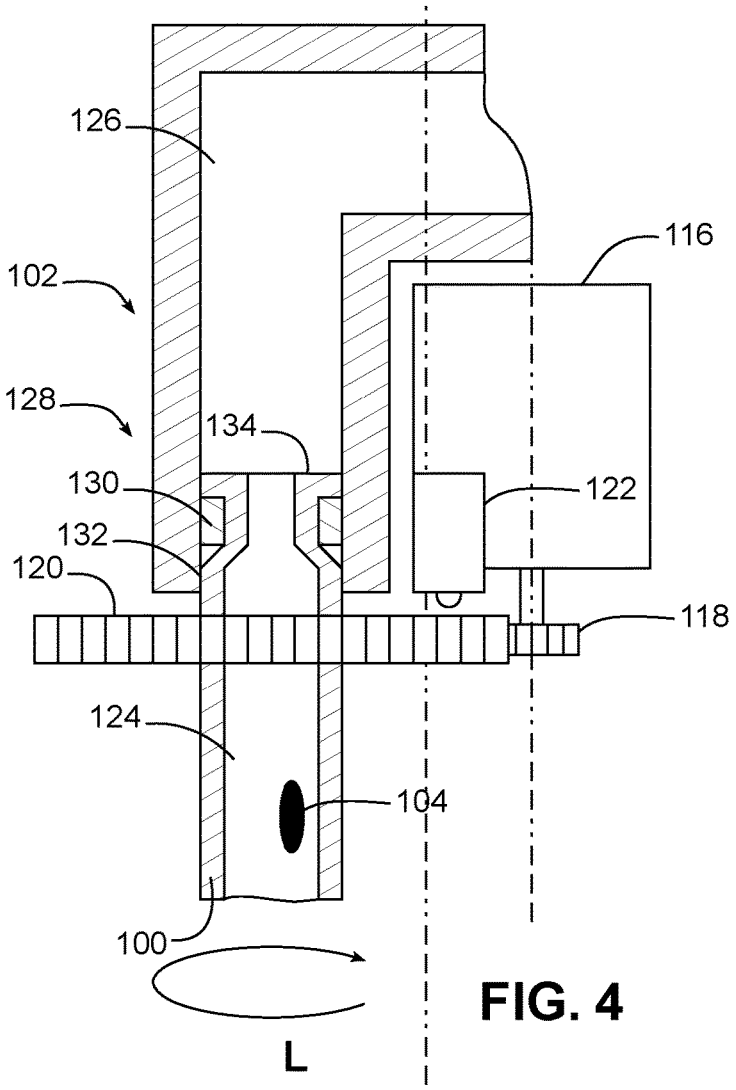
FIG. 4 is a partial cross-sectional view of the tubular spray element and tubular spray element drive of FIG. 3.

FIG. 4 illustrates one example implementation of tubular spray element 100 and tubular spray element drive 102 in greater detail, with housing 114 omitted for clarity. In this implementation, tubular spray element drive 102 includes an electric motor 116, which may be an alternating current (AC) or direct current (DC) motor, e.g., a brushless DC motor, a stepper motor, etc., which is mechanically coupled to tubular spray element 100 through a gearbox including a pair of gears 118, 120 respectively coupled to motor 116 and tubular spray element 100. Other manners of mechanically coupling motor 116 to tubular spray element 100 may be used in other embodiments, e.g., different numbers and/or types of gears, belt and pully drives, magnetic drives, hydraulic drives, linkages, friction, etc.

In addition, an optional position sensor 122 may be disposed in tubular spray element drive 102 to determine a rotational position of tubular spray element 100 about axis L. Position sensor 122 may be an encoder or hall sensor in some embodiments, or may be implemented in other manners, e.g., integrated into a stepper motor, whereby the rotational position of the motor is used to determine the rotational position of the tubular spray element. Position sensor 122 may also sense only limited rotational positions about axis L (e.g., a home position, 30 or 45 degree increments, etc.). Further, in some embodiments, rotational position may be controlled using time and programming logic, e.g., relative to a home position, and in some instances without feedback from a motor or position sensor. Position sensor 122 may also be external to tubular spray element drive 102 in some embodiments.

An internal passage 124 in tubular spray element 100 is in fluid communication with an internal passage 126 leading to port 108 (not shown in FIG. 4) in tubular spray element drive 102 through a rotary coupling 128. In one example implementation, coupling 128 is formed by a bearing 130 mounted in passageway 126, with one or more deformable tabs 134 disposed at the end of tubular spray element 100 to secure tubular spray element 100 to tubular spray element drive 102. A seal 132, e.g., a lip seal, may also be formed between tubular spray element 100 and tubular spray element drive 102. Other manners of rotatably coupling the tubular spray element while providing fluid flow may be used in other embodiments.

Figure 5:
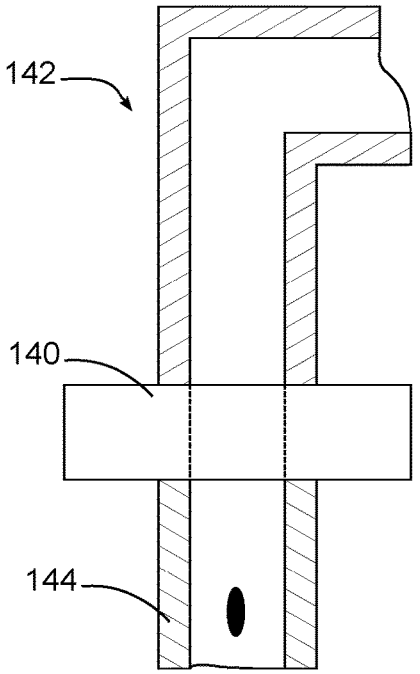
FIG. 5 is a partial cross-sectional view of another tubular spray element and tubular spray element drive consistent with some embodiments of the invention, and including a valve for restricting flow to the tubular spray element.

Turning to FIG. 5, it also may be desirable in some embodiments to incorporate a valve 140 into a tubular spray element drive 142 to regulate the fluid flow to a tubular spray element 144 (other elements of drive 142 have been omitted from FIG. 5 for clarity). Valve 140 may be an on/off valve in some embodiments or may be a variable valve to control flow rate in other embodiments. In still other embodiments, a valve may be external to or otherwise separate from a tubular spray element drive, and may either be dedicated to the tubular spray element or used to control multiple tubular spray elements. Valve 140 may be integrated with or otherwise proximate a rotary coupling between tubular spray element 144 and tubular spray element drive 142. By regulating fluid flow to tubular spray elements, e.g., by selectively shutting off tubular spray elements, water can be conserved and/or high-pressure zones can be created by pushing all of the hydraulic power through fewer numbers of tubular spray elements.

In some embodiments, valve 140 may be actuated independent of rotation of tubular spray element 144, e.g., using an iris valve, butterfly valve, gate valve, plunger valve, piston valve, valve with a rotatable disc, ball valve, etc., and actuated by a solenoid, motor or other separate mechanism from the mechanism that rotates tubular spray element 144. In other embodiments, however, valve 140 may be actuated through rotation of tubular spray element 144. In some embodiments, for example, rotation of tubular spray element 144 to a predetermined rotational position may close valve 140, e.g., where valve 140 includes an arcuate channel that permits fluid flow over only a range of rotational positions. In other embodiments, a valve may be actuated through over-rotation of a tubular spray element, or through counter rotation of a tubular spray element. Further, in some embodiments, a valve may be variable, e.g., configured as an iris valve, to regulate fluid flow to the tubular spray element, and may be independently actuated from rotation of a tubular spray element in some embodiments (e.g., via a solenoid or motor), or may be actuated through rotation of a tubular spray element, e.g., through rotation to a predetermined position, an over-rotation, or a counter-rotation, using appropriate mechanical linkages. Other variations will be appreciated by those of ordinary skill having the benefit of the instant disclosure.

Figure 6:
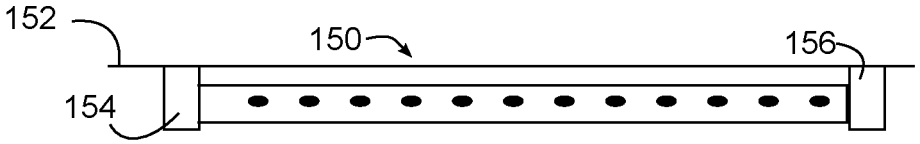
FIG. 6 is a functional top plan view of an example implementation of a wall-mounted tubular spray element and tubular spray element drive consistent with some embodiments of the invention.
Figure 7:
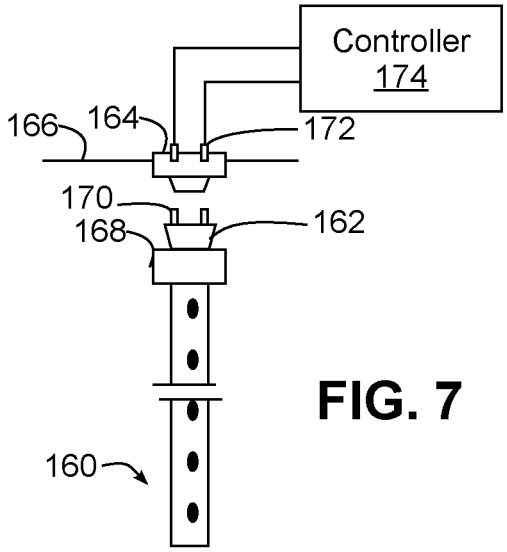
FIG. 7 is a functional top plan view of an example implementation of a rack-mounted tubular spray element and tubular spray element drive consistent with some embodiments of the invention.
Figure 8:
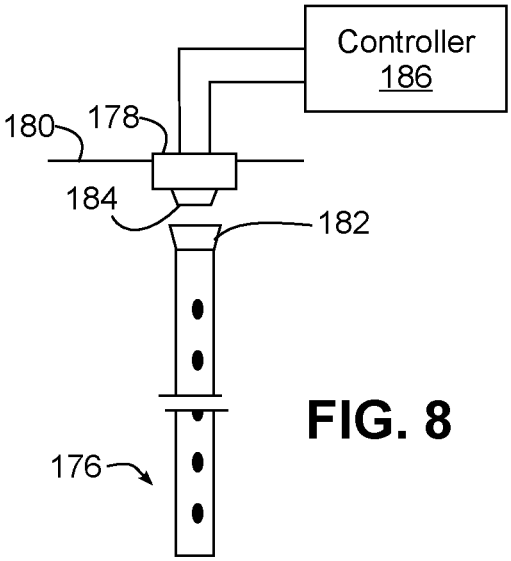
FIG. 8 is a functional top plan view of another example implementation of a rack-mounted tubular spray element and tubular spray element drive consistent with some embodiments of the invention.

Now turning to FIGS. 6-8, tubular spray elements may be mounted within a wash tub in various manners in different embodiments. As illustrated by FIGS. 1 and 3 (discussed above), a tubular spray element in some embodiments may be mounted to a wall (e.g., a side wall, a back wall, a top wall, a bottom wall, or a door) of a wash tub, and may be oriented in various directions, e.g., horizontally, vertically, front-to-back, side-to-side, or at an angle. It will also be appreciated that a tubular spray element drive may be disposed within a wash tub, e.g., mounted on wall of the wash tub or on a rack or other supporting structure, or alternatively some or all of the tubular spray element drive may be disposed external from a wash tub, e.g., such that a portion of the tubular spray element drive or the tubular spray element projects through an aperture in the wash tub. Alternatively, a magnetic drive could be used to drive a tubular spray element in the wash tub using an externally-mounted tubular spray element drive.

Moreover, as illustrated by tubular spray element 150 of FIG. 6, rather than being mounted in a cantilevered fashion as is the case with tubular spray element 100 of FIG. 3, a tubular spray element may also be mounted on a wall 152 of a wash tub and supported at both ends by hubs 154, 156, one or both of which may include the components of the tubular spray element drive. In this regard, the tubular spray element 150 runs generally parallel to wall 152 rather than running generally perpendicular thereto, as is the case with tubular spray element 100 of FIG. 3.

In still other embodiments, a tubular spray element may be rack-mounted. FIG. 7, for example, illustrates a tubular spray element 160 mountable on rack (not shown) and dockable via a dock 162 to a docking port 164 on a wall 166 of a wash tub. In this embodiment, a tubular spray element drive 168 is also rack-mounted, and as such, in addition to a fluid coupling between dock 162 and docking port 164, a plurality of cooperative contacts 170, 172 are provided on dock 162 and docking port 164 to provide power to tubular spray element drive 168 as well as electrical communication with a controller 174.

As an alternative, and as illustrated in FIG. 8, a tubular spray element 176 may be rack-mounted, but separate from a tubular spray element drive 178 that is not rack-mounted, but is instead mounted to a wall 180 of a wash tub. A dock 182 and docking port 184 provide fluid communication with tubular spray element 176, along with a capability to rotate tubular spray element 176 about its longitudinal axis under the control of tubular spray element drive 178. Control over tubular spray element drive 178 is provided by a controller 186. In some instances, tubular spray element drive 178 may include a rotatable and keyed channel into which an end of a tubular spray element may be received.

Figure 9:
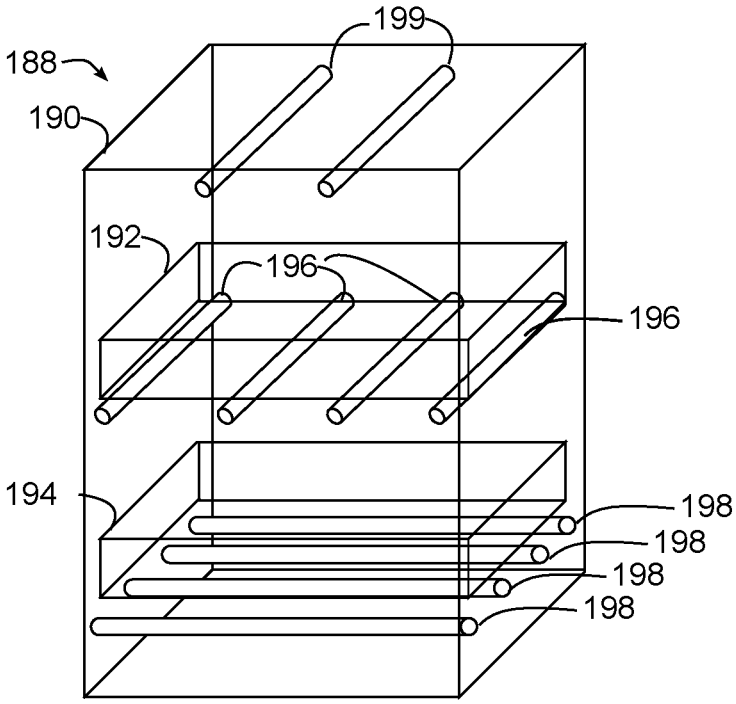
FIG. 9 is a functional perspective view of a dishwasher incorporating multiple tubular spray elements and consistent with some embodiments of the invention.

FIG. 9 next illustrates a dishwasher 188 including a wash tub 190 and upper and lower racks 192, 194, and with a number of tubular spray elements 196, 198, 199 distributed throughout the wash tub 190 for circulating a wash fluid through the dishwasher. Tubular spray elements 196 may be rack-mounted, supported on the underside of upper rack 192, and extending back-to-front within wash tub 190. Tubular spray elements 196 may also dock with back wall-mounted tubular spray element drives (not shown in FIG. 9), e.g., as discussed above in connection with FIG. 8. In addition, tubular spray elements 196 may be rotatably supported at one or more points along their respective longitudinal axes by couplings (not shown) suspended from upper rack 192. Tubular spray elements 196 may therefore spray upwardly into upper rack 192 and/or downwardly onto lower rack 194, and in some embodiments, may be used to focus wash fluid onto a silverware basket or other region of either rack to provide for concentrated washing. Tubular spray elements 198 may be wall-mounted beneath lower rack 194, and may be supported at both ends on the side walls of wash tub 190 to extend in a side-to-side fashion, and generally transverse to tubular spray elements 196. Each tubular spray element 196, 198 may have a separate tubular spray element drive in some embodiments, while in other embodiments some or all of the tubular spray elements 196, 198 may be mechanically linked and driven by common tubular spray element drives.

In some embodiments, tubular spray elements 196, 198 by themselves may provide sufficient washing action and coverage. In other embodiments, however, additional tubular spray elements, e.g., tubular spray elements 199 supported above upper rack 192 on one or both of the top and back walls of wash tub 190, may also be used. In addition, in some embodiments, additional spray arms and/or other sprayers may be used. It will also be appreciated that while 10 tubular spray elements are illustrated in FIG. 9, greater or fewer numbers of tubular spray elements may be used in other embodiments.

It will also be appreciated that in some embodiments, multiple tubular spray elements may be driven by the same tubular spray element drive, e.g., using geared arrangements, belt drives, or other mechanical couplings. Further, tubular spray elements may also be movable in various directions in addition to rotating about their longitudinal axes, e.g., to move transversely to a longitudinally axis, to rotate about an axis of rotation that is transverse to a longitudinal axis, etc. In addition, deflectors may be used in combination with tubular spray elements in some embodiments to further the spread of fluid and/or prevent fluid from hitting tub walls. In some embodiments, deflectors may be integrated into a rack, while in other embodiments, deflectors may be mounted to a wall of the wash tub. In addition, deflectors may also be movable in some embodiments, e.g., to redirect fluid between multiple directions. Moreover, while in some embodiments tubular spray elements may be used solely to spray wash fluid, in other embodiments tubular spray elements may be used to spray pressurized air at utensils during a drying operation of a wash cycle, e.g., to blow off water that pools on cups and dishes after rinsing is complete. In some instances, different tubular spray elements may be used to spray wash fluid and spray pressurized air, while in other instances the same tubular spray elements may be used to alternately or concurrently spray wash liquid and pressurized air.

Tubular Spray Element with Intermediate Support and/or Fluid Inlet

As noted above, the placement of one or more tubular spray elements within the lower area of a wash tub under the lower rack can present challenges in some dishwasher designs, particularly when there is a seam that joins a wash tub bottom to a wash tub wrapper. In embodiments consistent with the invention, however, a tubular spray element may be rotatably supported and/or supplied with fluid at an intermediate location on the tubular spray element, i.e., at a location along the length of the tubular spray element that is intermediate the opposing ends of the tubular spray element and positioned such that at least one aperture that sprays fluid into the wash tub is positioned on both sides of the intermediate location. In some embodiments, the intermediate rotatable support and fluid supply features may be supported in a manifold that is mounted to the bottom of the wash tub and supplied with fluid from a diverter disposed in the bottom of the wash tub, such that the supply of fluid to the tubular spray element is provided entirely within the wash tub. Moreover, in some embodiments, the tubular spray element drive that rotates the tubular spray element is disposed externally from the wash tub, but mechanically coupled to the tubular spray element using a drive shaft that projects through a wall of the wash tub and is sealed by a shaft seal.

The embodiments discussed hereinafter focus, in particular, on a tubular spray element spray system that is positioned in the bottom portion of a wash tub and that is used to spray fluid primarily upwardly into a lower rack of a dishwasher, and thus perform similar washing action to a lower spray arm that is commonly used in many dishwasher designs to spray into a lower rack. It will be appreciated, however, that in other embodiments, the techniques described herein may also be used in other locations in a dishwasher, including above, within or below any rack of a dishwasher, and may also be used in rack-mounted designs where a tubular spray element is supported by a rack or other movable structure rather than by a fixed structure of or within a wash tub.

Figure 10:
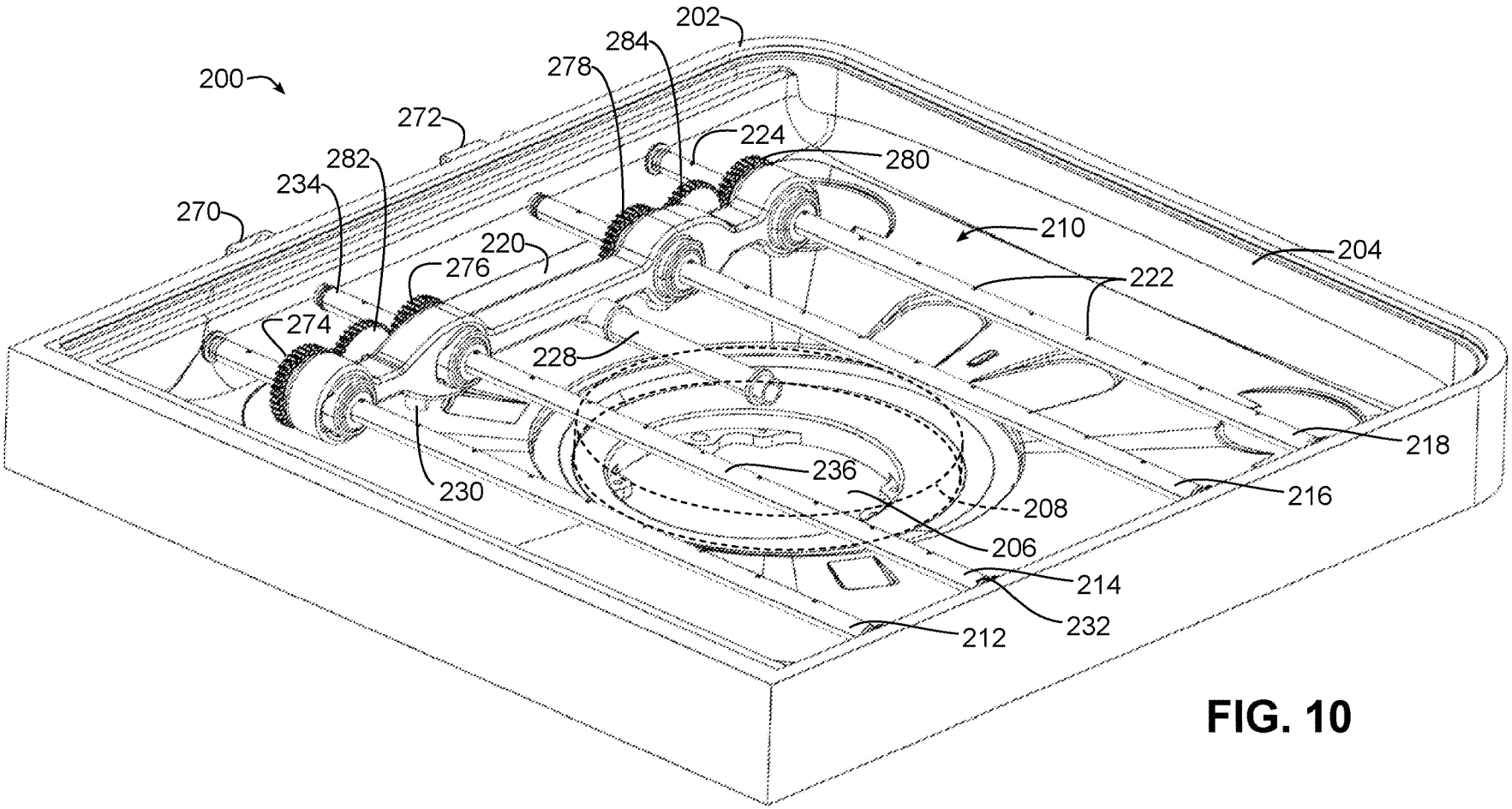
FIG. 10 is a perspective view of an example implementation of a dishwasher including a tubular spray element spray system disposed in a bottom portion of a wash tub and consistent with some embodiments of the invention.

FIGS. 10-14, for example, illustrate an example dishwasher 200 incorporating the techniques described herein, and as illustrated in FIG. 10, includes a wash tub 202, of which only a bottom portion 204 thereof is illustrated. It will be appreciated that wash tub 202 may also include side, back and top walls that are not shown, and that are provided, for example, on separate components such as wrappers or caps, or that in some embodiments may be integrated into a single integrated wash tub component with bottom portion 204. In some embodiments, for example, the bottom portion and/or walls of wash tub 202 may be formed of stainless steel and/or injection molded plastic. A sump portion 206 is disposed centrally in bottom portion 204 to receive wash fluid for recirculation and/or draining by a pump (not shown), and in the illustrated embodiment, a diverter 208 (which is shown in phantom) is positioned over the sump portion in order to route fluid to one or more outlets to various sprayers in the dishwasher to spray utensils disposed in one or more racks of the dishwasher.

Figure 11:
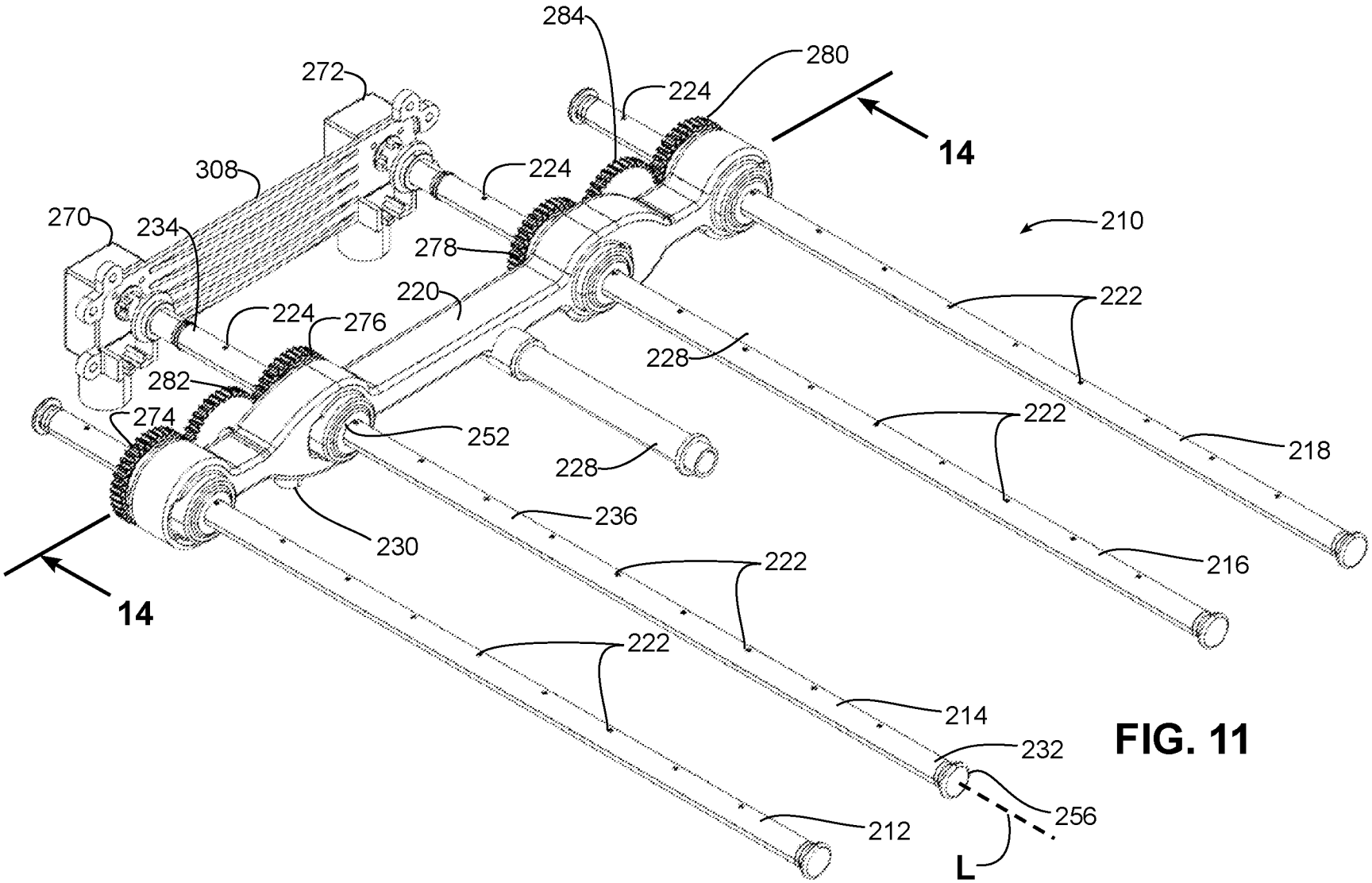
FIG. 11 is a perspective view of the tubular spray element spray system of FIG. 10.

As best shown in FIGS. 10-11, a tubular spray element spray system 210, including four tubular spray elements 212, 214, 216, 218, includes a manifold 220 that is disposed within wash tub 202 and supported by bottom portion 204 to both rotatably support and supply fluid to tubular spray elements 212-218, and to do so from an intermediate location on each tubular spray element 212-218.

Specifically, each tubular spray element 212-218 is disposed in wash tub 202 and is rotatable about a longitudinal axis thereof, e.g., longitudinal axis L of tubular spray element 214 (FIG. 11). In the illustrated embodiment, the longitudinal axes of tubular spray elements 212-218 are parallel with one another, although the invention is not so limited. Each tubular spray element 212-218 includes a plurality of apertures 222, 224 extending through an exterior surface thereof, of which a portion of the apertures, e.g., apertures 222, are disposed to one side of manifold 220, and another portion thereof, e.g., apertures 224, are disposed to the other side of manifold 220. As such, each tubular spray element 212-218 effectively projects through opposing sides of manifold 220. In addition, as illustrated by tubular spray element 214 in FIG. 13, each tubular spray element 212-218 also includes a fluid inlet 226 disposed between one of apertures 222 and one of apertures 224 among the plurality of apertures 222, 224. Fluid inlet 226 is in fluid communication with a fluid supply through manifold 220, conduit 228 and diverter 208 to direct fluid received from the fluid supply into wash tub 202 through the plurality of apertures 222, 224.

Figure 14:
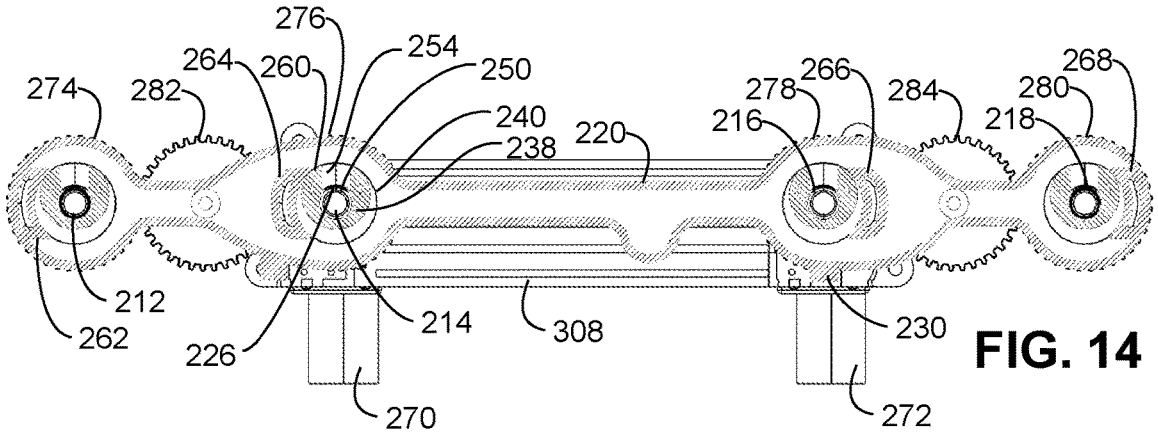
FIG. 14 is a cross-sectional view of the tubular spray element spray system of FIG. 11, and taken along lines 14-14 thereof.

Returning to FIGS. 10-11, and with additional reference to FIG. 14, manifold 220 receives fluid from diverter 208 through a conduit 228, and may be supported, for example, by one or more legs 230. Legs 230 may be secured in various manners to bottom portion 204 to effectively mount manifold 220 to bottom portion 204, e.g., via screws or other fasteners, locking tabs, or with a portion thereof integrally molded with the bottom portion. In other embodiments, manifold 220 may simply rest on top of bottom portion 204, with other structures (e.g., the mechanical couplings to tubular spray element drives and/or the coupling of conduit 228 to diverter 208) used to fix the location of the manifold in the bottom portion.

Manifold 220, in addition to supplying fluid to each tubular spray element 212-218, also functions as a tubular spray element support that is configured to rotatably support each tubular spray element 212-218 intermediate opposing ends of the tubular spray element (e.g., intermediate free end 232 and drive end 234 of tubular spray element 214), with at least one aperture disposed intermediate manifold 220 and one end of the tubular spray element and at least one aperture disposed intermediate manifold 220 and the other end of the tubular spray element (e.g., apertures 222 between manifold 220 and free end 232 of tubular spray element 214 and apertures 224 between manifold 220 and drive end 234 of tubular spray element 214).

While manifold 220 serves both as a fluid supply and a rotatable support for each tubular spray element 212-218 in the illustrated embodiment, in other embodiments, these functions may be handled by different components (e.g., with a fluid inlet at one intermediate location along the length of a tubular spray element and one or more rotatable supports at other intermediate locations along the length of the tubular spray element). In other embodiments, an intermediate fluid inlet and supply thereto may be used without using any intermediate rotatable support, or vice versa. As such, the invention is not limited to the specific configuration disclosed herein, as will be appreciated by those of ordinary skill having the benefit of the instant disclosure.

Figure 13:
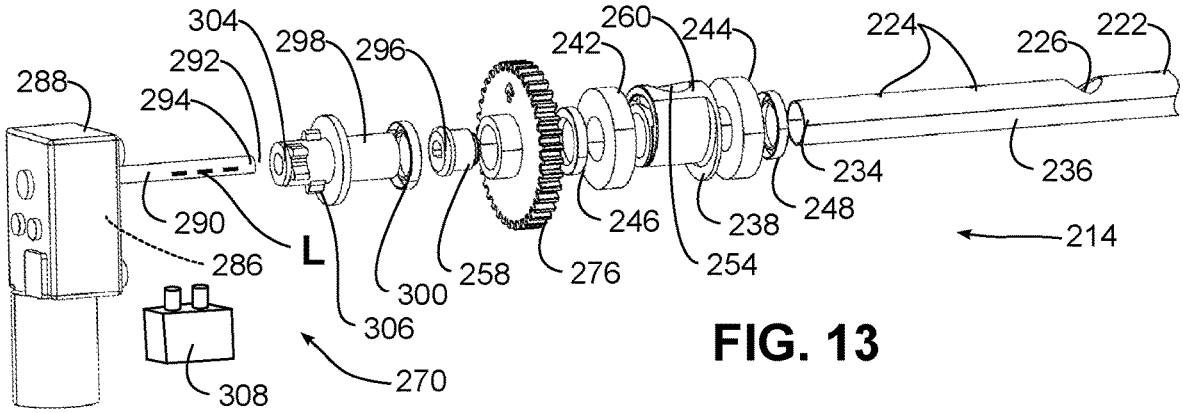
FIG. 13 is an exploded perspective view of one of the tubular spray elements and tubular spray element drives from the tubular spray element spray system of FIG. 10.

As best shown in FIGS. 13 and 14, and with a specific focus on tubular spray element 214, each tubular spray element in the illustrated embodiment may include an elongated tube, e.g., an elongated metal tube 236, within which apertures 222, 224 and fluid inlet 226 are defined. Each tubular spray element also includes an integrated diverter valve that is capable of selectively enabling or restricting fluid flow to the tubular spray element based upon the rotational position of the tubular spray element. For tubular spray element 214, a valve member 238 is fit over elongated metal tube 236 (e.g., using a set screw or pressure fitting) and is configured to be received within a bearing support 240 defined in manifold 220. Bearings 242, 244 are disposed on opposite sides of valve member 238 to rotatably support elongated metal tube 236 in manifold 220, and seals 246, 248 (e.g., radial lip seals or other suitable seals) are disposed on opposite sides of bearings 242, 244 to seal openings 250, 252 in manifold 220. Caps or plugs 256, 258 are also fit into elongated metal tube 236 at free end 232 and drive end 234 to seal the ends of the tube.

Valve member 238 includes an opening 254 and a face 260 that is radially facing with respect to longitudinal axis L and that aligns with fluid inlet 226 on elongated metal tube 236. Moreover, as illustrated in FIG. 14, manifold 220 includes, for each tubular spray element 212, 214, 216, 218, an associated radially-facing valve body 262, 264, 266, 268 having a radius relative to the longitudinal axis of the associated tubular spray element that effectively operates to selectively restrict fluid flow to a tubular spray element 212-218 when that tubular spray element is rotated to a predetermined rotational position. For tubular spray element 214, for example, valve body 264 is positioned such that if the tubular spray element 214 is rotated about 90 degrees counter-clockwise from the view of FIG. 14, opening 254 of valve member 238 will be closed by the respective positioning of face 260 and valve body 264. At other rotational positions, however (e.g., the upward position illustrated in FIG. 14), fluid flow into opening 254 is unrestricted, so fluid is allowed to flow into fluid inlet 226 and out of apertures 222, 224. Similarly, for tubular spray element 212, a 90 degree counter-clockwise rotation from the view of FIG. 14 operates effectively as an "off" position for the tubular spray element, while for tubular spray elements 216, 218, a 90 degree clockwise rotation from the view of FIG. 14 corresponds to the "off" positions for those tubular spray elements. It will be appreciated that in other embodiments, no diverter valves may be used, or restriction of flow to a tubular spray element may be implemented in the various other manners discussed above.

Returning to FIGS. 10-11, in the illustrated embodiment, tubular spray element spray system 210 includes four tubular spray elements driven by two tubular spray element drives 270, 272, with tubular spray elements 212, 214 driven by tubular spray element drive 270 and tubular spray elements 216, 218 driven by tubular spray element drive 272. Each tubular spray element 212, 214, 216, 218 includes an associated gear 274, 276, 278, 280, which may be secured via a set screw or other fastener, a press fitting, a retaining tab, or in other suitable manners that will be appreciated by those of ordinary skill having the benefit of the instant disclosure. An idler gear 282 is rotatably mounted on manifold 220 intermediate gears 274 and 276 such that tubular spray elements 212, 214 are mechanically coupled to one another and rotate collectively in the same direction, and similarly, an idler gear 284 is rotatably mounted on manifold 220 intermediate gears 278 and 280 such that tubular spray elements 216, 218 are mechanically coupled to one another and rotate collectively in the same direction. The gearing ratios are selected such that the tubular spray elements in each pair rotate at the same rate, and thus maintain the same relative rotation angles between one another throughout their rotation, although the invention is not so limited.

As noted above, it is desirable in some embodiments for the fluid supply to each tubular spray element to be entirely within wash tub 202. As such, it will be appreciated that in the illustrated embodiment, the fluid supplied by diverter 208 is provided to components that are entirely within the wash tub, namely conduit 228 and manifold 220. Thus, for tubular spray element 214, these components supply fluid into fluid inlet 226 from the intermediate location, and both ends 232, 234 are sealed via plugs 256, 258.

In such embodiments, and as illustrated in FIGS. 10-14, it may be desirable to utilize a tubular spray element drive incorporating a motor, and in some instances, a position sensor, that are disposed externally from a wash tub and mechanically coupled to a one or more tubular spray elements using a drive shaft that projects through the wash tub through a shaft seal.

For tubular spray element drive 270, for example, and as illustrated in FIG. 13, a motor 286 may be housed in a housing 288 and may include a drive shaft 290 having an end 292 upon which is disposed a drive component 294 that is disposed within wash tub 202. In the embodiment of FIGS. 10-14, drive component 294 is implemented as a keyed coupler, e.g., having a "D" cross section, or any other suitable geometry. Drive shaft 290 extends along longitudinal axis L, and tubular spray element 214 includes disposed at drive end 234 a cooperative keyed coupler in the form of a keyed recess 296 in plug 258 that has a similar cross sectional profile as drive component 294 (i.e., a "D" cross section). As such, when end 292 of drive shaft 290 is received in recess 296 of plug 258, drive shaft 290 is mechanically coupled to tubular spray element 214 with the keyed couplers defined by drive shaft 290 and plug 258 restricting relative rotation between the drive shaft and plug, thus enabling rotation of drive shaft 290 about longitudinal axis L to drive rotation of tubular spray element 214 (and by virtue of gears 274, 276 and 282, tubular spray element 212 as well). It should also be noted that as tubular spray elements 212 and 218 are not directly driven, plugs received in the ends thereof may omit any keyed recesses.

Figure 12:
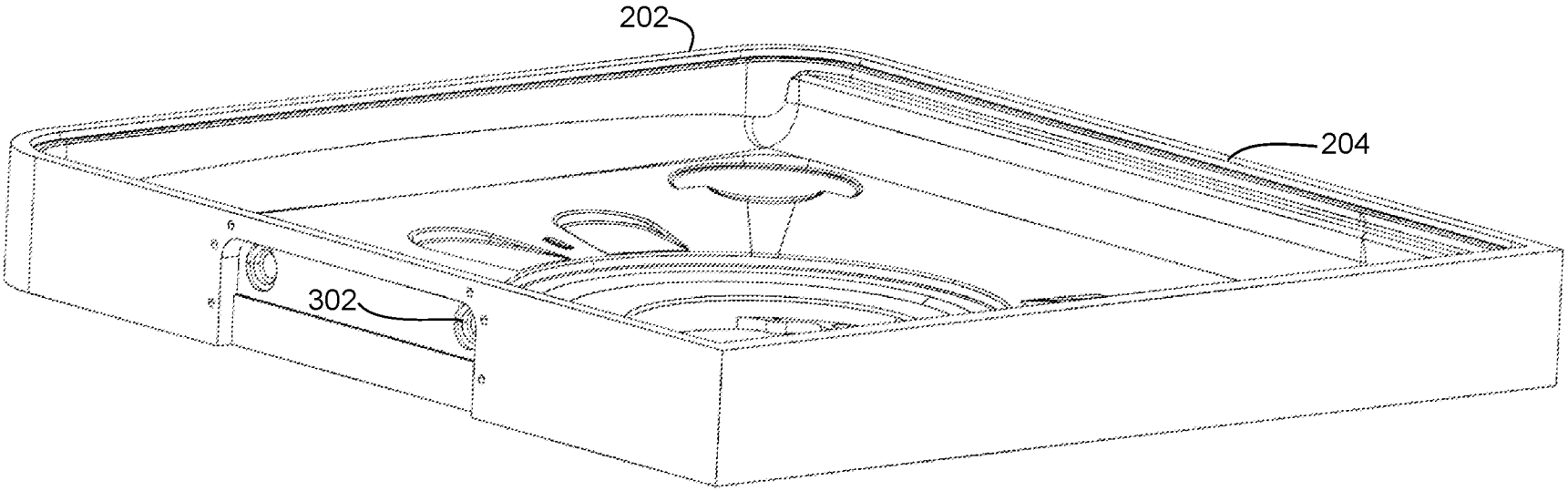
FIG. 12 is a perspective view of the bottom portion of the wash tub of FIG. 10, and illustrating the access apertures for the tubular spray element drives of the tubular spray element spray system.

A shaft seal for drive shaft 290 is provided by a seal body 298 and lip seal 300, which, as best illustrated in FIG. 12, may be received in a stepped port 302 in bottom portion 204 and may restrict the passage of fluid within the wash tub through the stepped port and/or around drive shaft 290. Seal body 298 has a keyed sleeve 304 that has a similar "D" cross section to drive shaft 290 such that seal body 298 rotates with drive shaft 290 when installed thereon. While other manners of sensing position may be used in other embodiments, in the embodiment of FIGS. 10-14, seal body 298 also includes a set of cams 306 that are used to engage a position sensor 308 (e.g., a microswitch, hall effect sensor, etc.) and sense the rotational position of drive shaft 290, and thus of tubular spray element 214. In addition, with further reference to FIGS. 10-12, both tubular spray element drives 270, 272 may be mounted to a bracket 308, which is in turn mounted to bottom portion 204, e.g., using screws, fasteners, tabs or other appropriate fastening arrangements, thus securing both tubular spray element drives externally from the wash tub but with drive shafts projecting through shaft seals and into the wash tub.

Figure 15:
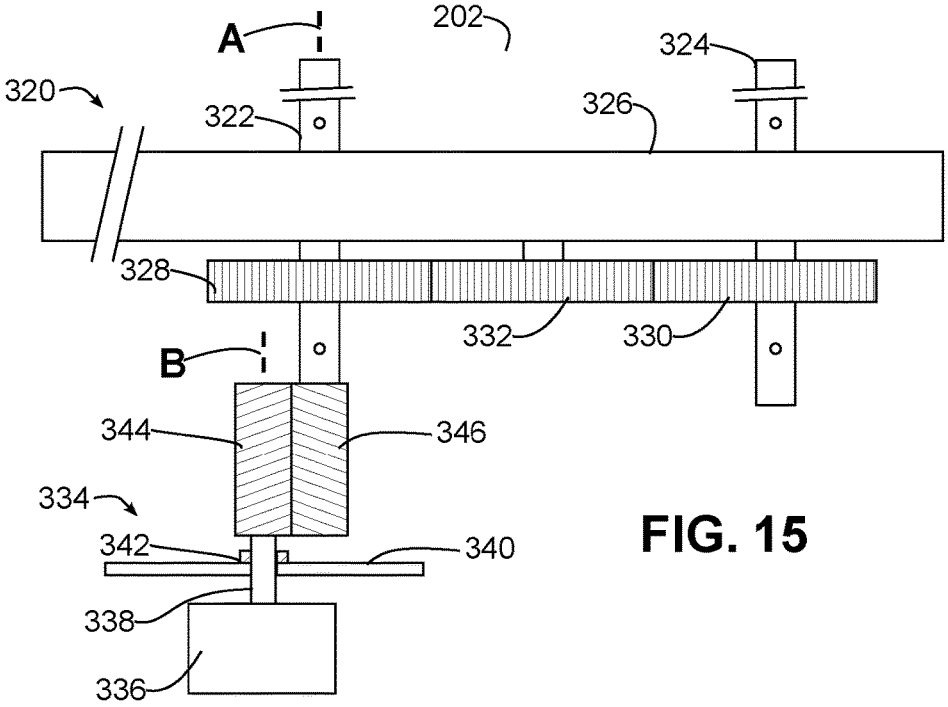
FIG. 15 is a top plan view of another example implementation of a tubular spray element spray system consistent with some embodiments of the invention.

As noted above, in the illustrated embodiment of FIGS. 10-14, drive component 294 is integrally formed on drive shaft 290 and both drive shaft 290 and drive component 294 extend along longitudinal axis L of tubular spray element 214. In other embodiments, however, other drive components, mechanical couplings, and/or drive arrangements may be used. FIG. 15, for example, illustrates another example tubular spray element spray system 320 in which a pair of tubular spray elements 322, 324 are rotatably supported by and supplied with fluid at intermediate locations by a manifold 326, and mechanically coupled to one another by a set of gears 328, 330, 332, all in a similar manner to tubular spray element spray system 210 of FIGS. 10-14. A tubular spray element drive 334 includes a motor 336 and a drive shaft 338 that projects through a wash tub wall 340 through a shaft seal 342. Rather than extending along the longitudinal axis of tubular spray element 322 (labeled A in FIG. 15); however, drive shaft 338 extends along and rotates about an axis B that is substantially parallel to longitudinal axis A, and a pair of gears 344, 346 (e.g., helical gears) are respectively disposed on drive shaft 338 and tubular spray element 322, with gear 346 mating with and driven by gear 344 such that rotation of drive shaft 338 drives rotation of tubular spray element 322.

Other manners of mechanically coupling a drive shaft of a tubular spray element drive to a tubular spray element to drive rotation thereof will be appreciated by those of ordinary skill having the benefit of the instant disclosure, so the invention is not limited to the specific embodiments discussed herein. Moreover, it will be appreciated that a wide variety of shaft seal designs may be used to seal a wash tub at a location where a drive shaft projects through a wall of the wash tub.

In addition, it will be appreciated that different numbers and arrangements of tubular spray elements, tubular spray element drives, manifold designs, tubular spray element support designs, etc. may be used in other embodiments. Furthermore, tubular spray elements may be individual controlled in some embodiments, or more than two tubular spray elements may be controlled by an individual tubular spray element drive. Tubular spray elements with intermediate rotatable supports and/or intermediate fluid inlets may also be used in rack-mounted applications and/or in other locations in a wash tub.

Various other modifications may be made to the illustrated embodiments without departing from the spirit and scope of the invention. Therefore, the invention lies in the claims hereinafter appended.

What is claimed is:

1. A dishwasher, comprising:

a wash tub;

a tubular spray element disposed in the wash tub and being rotatable about a longitudinal axis thereof, the tubular spray element including a plurality of apertures extending through an exterior surface thereof, and the tubular spray element including a fluid inlet disposed between first and second apertures among the plurality of apertures, the fluid inlet in fluid communication with a fluid supply to direct fluid received from the fluid supply into the wash tub through the plurality of apertures; and a tubular spray element drive coupled to the tubular spray element and configured to rotate the tubular spray element between a plurality of rotational positions about the longitudinal axis thereof.

2. The dishwasher of claim 1, wherein the tubular spray element includes first and second opposing ends that are sealed and disposed in the wash tub.

3. The dishwasher of claim 1, wherein the tubular spray element drive includes:

a motor disposed external to the wash tub;

a drive shaft driven by the motor and projecting through the wash tub through a shaft seal; and a drive component driven by the drive shaft and disposed within the wash tub, the drive component mechanically coupled to the tubular spray element such that rotation of the motor drives the drive shaft and the drive component to rotate the tubular spray element.

4. The dishwasher of claim 3, wherein the drive shaft extends along the longitudinal axis, and wherein the drive component comprises a first keyed coupler engaging a second keyed coupler disposed at an end of the tubular spray element.

5. The dishwasher of claim 3, wherein the drive shaft extends substantially parallel to the longitudinal axis, and the drive component comprises a first gear and the tubular spray element includes a second gear that mates with and is driven by the first gear.

6. The dishwasher of claim 1, wherein the tubular spray element drive includes a position sensor configured to sense a rotational position of the tubular spray element, and the dishwasher further comprises a controller coupled to the tubular spray element drive and configured to control the tubular spray element drive to discretely direct the tubular spray element to a predetermined rotational position to direct fluid from the fluid supply in a predetermined direction from the plurality of apertures.

7. The dishwasher of claim 1, further comprising a manifold disposed in the wash tub and in fluid communication with the fluid supply, wherein the tubular spray element projects through opposing sides of the manifold and the fluid inlet is disposed within the manifold.

8. The dishwasher of claim 7, further comprising a diverter configured to selectively route wash fluid from the fluid supply to one or more of a plurality of outlets, wherein the manifold is in fluid communication with a first outlet of the plurality of outlets.

9. The dishwasher of claim 7, wherein the tubular spray element further includes a radially-facing inlet in fluid communication with the fluid inlet and disposed on a valve member that rotates with the tubular spray element, and wherein the manifold includes a radially-facing valve body disposed at a predetermined radius from the longitudinal axis to substantially block fluid flow from the manifold to the fluid inlet when the tubular spray element is rotated to a predetermined rotational position about the longitudinal axis.

10. The dishwasher of claim 7, wherein the manifold is mounted to a bottom portion of the wash tub and supports the tubular spray element within the wash tub.

11. The dishwasher of claim 10, wherein the manifold is mounted to a bottom of the wash tub.

12. The dishwasher of claim 7, wherein the tubular spray element is a first tubular spray element, the dishwasher further comprising a second tubular spray element disposed in the wash tub and being rotatable about a longitudinal axis thereof, the second tubular spray element supported by the manifold and extending substantially parallel to the first tubular spray element.

13. The dishwasher of claim 12, wherein the first and second tubular spray elements are mechanically coupled to one another such that rotation of the first tubular spray element by the tubular spray element drive rotates the second tubular spray element.

14. The dishwasher of claim 13, wherein the first and second tubular spray elements include respective first and second gears, and wherein the manifold includes a third gear interposed between the first and second gears such that the first and second tubular spray elements rotate in a same direction when the first tubular spray element is rotated by the tubular spray element drive.

15. The dishwasher of claim 13, wherein the tubular spray element drive is a first tubular spray element drive, the dishwasher further comprising:

third and fourth tubular spray elements disposed in the wash tub and being rotatable about respective longitudinal axes thereof, each of the third and fourth tubular spray elements supported by the manifold and extending substantially parallel to the first and second tubular spray elements, and the third and fourth tubular spray elements mechanically coupled to one another such that rotation of the third tubular spray element rotates the fourth tubular spray element; and a second tubular spray element drive coupled to the third tubular spray element and configured to rotate the third tubular spray element between a plurality of rotational positions about the longitudinal axis thereof.

16. The dishwasher of claim 1, further comprising a rack for storing utensils to be washed, wherein the tubular spray element extends underneath the rack to spray upwardly into the rack, the rack is a lower rack, and the tubular spray element is positioned proximate to a bottom of the wash tub.

17. The dishwasher of claim 1, further comprising a tubular spray element support configured to rotatably support the tubular spray element intermediate first and second opposing ends thereof, wherein at least one of the plurality of apertures is disposed intermediate the first end and the tubular spray element support and at least one of the plurality of apertures is disposed intermediate the second end and the tubular spray element support.

18. The dishwasher of claim 1, wherein the first and second apertures and the fluid inlet are respectively positioned at first, second, and third positions along the longitudinal axis of the tubular spray element, and the third position is between the first and second positions.

19. A dishwasher, comprising:

a wash tub;

a tubular spray element disposed in the wash tub and being rotatable about a longitudinal axis thereof, the tubular spray element including a plurality of apertures extending through an exterior surface thereof and configured to direct fluid received by the tubular spray element from a fluid supply into the wash tub; and a tubular spray element support supported on a bottom portion of the wash tub and configured to rotatably support the tubular spray element intermediate first and second opposing ends thereof, wherein at least one of the plurality of apertures is disposed intermediate the first end and the tubular spray element support and at least one of the plurality of apertures is disposed intermediate the second end and the tubular spray element support.

20. The dishwasher of claim 19, wherein the tubular spray element support comprises a manifold configured to receive fluid from the fluid supply, and wherein the tubular spray element includes a fluid inlet positioned within the manifold and configured to route fluid from the manifold to the plurality of apertures.

21. A dishwasher, comprising:

a wash tub;

a tubular spray element disposed in the wash tub and being rotatable about a longitudinal axis thereof, the tubular spray element including:

first and second opposing ends that are sealed and disposed in the wash tub;

a fluid inlet disposed in the wash tub and in fluid communication with a fluid supply; and a plurality of apertures extending through an exterior surface of the tubular spray element and configured to direct fluid received from the fluid supply into the wash tub; and a tubular spray element drive coupled to the tubular spray element and configured to rotate the tubular spray element between a plurality of rotational positions about the longitudinal axis thereof, the tubular spray element drive including:

a motor disposed external to the wash tub;

a drive shaft driven by the motor and projecting through the wash tub through a shaft seal; and a drive component driven by the drive shaft and disposed within the wash tub, the drive component mechanically coupled to the tubular spray element such that rotation of the motor drives the drive shaft and the drive component to rotate the tubular spray element.

22. The dishwasher of claim 21, further comprising a manifold in fluid communication with the fluid supply and configured to rotatably support the tubular spray element intermediate the first and second opposing ends thereof, wherein at least one of the plurality of apertures is disposed intermediate the first end and the manifold and at least one of the plurality of apertures is disposed intermediate the second end and the manifold, and wherein the fluid inlet is disposed within the manifold to receive fluid from the fluid supply.

* * * * *